United States Patent [19]

Bearden, Jr. et al.

[11] 4,149,959

[45] Apr. 17, 1979

[54] COAL LIQUEFACTION PROCESS

[75] Inventors: Roby Bearden, Jr.; Clyde L. Aldridge, both of Baton Rouge, La.

[73] Assignee: Exxon Research & Engineering Co., Florham Park, N.J.

[21] Appl. No.: 866,290

[22] Filed: Jan. 3, 1978

Related U.S. Application Data

[63] Continuation-in-part of Ser. No. 751,385, Dec. 17, 1976, Pat. No. 4,094,765.

[51] Int. Cl.[2] ..... C10G 1/00; C10G 1/06

[52] U.S. Cl. ..... 208/8 LE; 208/10

[58] Field of Search ..... 208/8, 10

[56] References Cited

U.S. PATENT DOCUMENTS 3,503,863 3/1970 Gatsis ..... 208/8

*Primary Examiner*—Delbert E. Gantz
*Assistant Examiner*—William G. Wright
*Attorney, Agent, or Firm*—Marthe L. Gibbons

[57] ABSTRACT

A coal liquefaction chargestock is first treated with a gaseous mixture comprising at least 5 mole percent hydrogen sulfide at a temperature varying from about 343° C. to about 449° C. for at least 8 minutes and thereafter subjected to coal liquefaction conditions.

14 Claims, 1 Drawing Figure

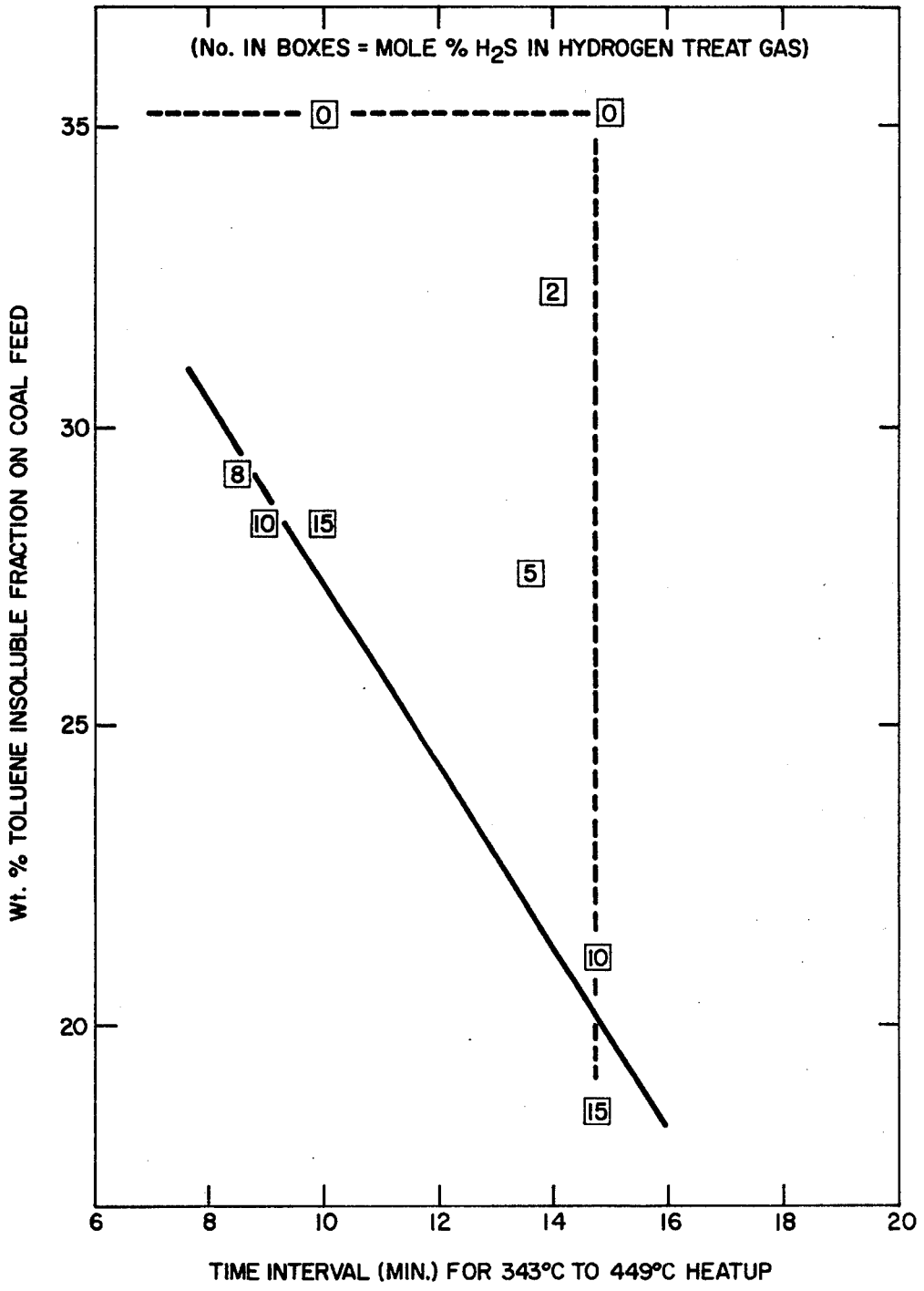
(No. IN BOXES = MOLE % $H_2S$ IN HYDROGEN TREAT GAS)
Wt. % TOLUENE INSOLUBLE FRACTION ON COAL FEED
35
30
25
20
6
8
10
12
14
16
18
20
TIME INTERVAL (MIN.) FOR 343°C TO 449°C HEATUP
0
0
2
8
10
15
5
10
15

COAL LIQUEFACTION PROCESS

CROSS REFERENCE TO RELATED APPLICATIONS

This application is a continuation-in-part of U.S. application Ser. No. 751,385 now U.S. Pat. No. 4,094,765 filed Dec. 17, 1976, the teachings of which are hereby incorporated by specific reference.

BACKGROUND OF THE INVENTION

1. Field of the Invention

The present invention relates to an improved coal liquefaction process. More particularly, the invention relates to a process comprising pretreatment of a coal liquefaction chargestock followed by coal liquefaction.

2. Description of the Prior Art

Coal liquefaction processes in which coal with or without a diluent is subjected to elevated temperatures and pressures to convert the coal to normally liquid hydrocarbonaceous products are well known. Coal liquefaction processes in which coal is converted in the presence of a hydrogen donor diluent with or without added hydrogen are also known. See for example U.S. Pat. No. 3,645,885 and U.S. Pat. No. 3,617,513, the teachings of which are hereby incorporated by reference.

U.S. Pat. No. 3,303,126 discloses a non-catalytic hydrorefining process for hydrocarbonaceous oils in which a mixture of hydrogen and hydrogen sulfide is utilized.

U.S. Pat. No. 3,271,302 discloses pretreatment of a hydrocarbon oil feed with hydrogen and hydrogen sulfide followed by catalytic hydrorefining.

U.S. Pat. No. 3,503,863 discloses the addition of hydrogen sulfide to a hydrogen donor solvent coal liquefaction process.

It has now been found that pretreatment of the coal liquefaction feed with a hydrogen sulfide-containing gas for a specific residence time at a given temperature gives improved coal liquefaction results such as coke suppression and an increase of liquid yield.

SUMMARY OF THE INVENTION

In accordance with the invention, there is provided a process for the liquefaction of coal, which comprises the steps of:

(a) treating a slurry comprising coal and a hydrogen donor diluent with a gaseous mixture comprising at least 5 mole percent hydrogen sulfide for a period of time of at least 8 minutes at a temperature varying from about 343° C to about 449° C, and (b) subjecting at least a portion of the product resulting from step (a) to coal liquefaction conditions in a coal liquefaction zone.

BRIEF DESCRIPTION OF THE DRAWING

The FIGURE is a graph showing the effect of pretreatment heat up time to liquid yields.

DESCRIPTION OF THE PREFERRED EMBODIMENTS

The process of the present invention is generally applicable to treating a slurry comprising coal and a hydrogen donor diluent. The term "coal" is used herein to designate a normally solid carbonaceous material including all ranks of coal, such as anthracite coal, bituminous coal, semibituminous coal, subbituminous coal, lignite, peat, and mixtures thereof.

Diluents useful in the practice of the present invention, defined in terms of hydrogen donor potential, are hydrogen donor diluents which contain at least 0.8 weight percent, generally 1.2 to about 3 weight percent or more donatable hydrogen, based on the weight of the diluent. The hydrogen donor diluent may be any of the known hydrogen donor diluents. The hydrogen donor diluent employed will typically be an intermediate stream boiling between 350° F. (176.67° C.) and about 800° F. (426.67° C.), preferably between about 400° F. (204.44° C.) and about 700° F. (371.11° C.) derived from a coal liquefaction process. This stream comprises hydrogenated aromatics, naphthenic hydrocarbons, phenolic materials and similar compounds and will normally contain at least 30 weight percent, preferably at least 50 weight percent, of compounds which are known to be hydrogen donors under the temperature and pressure conditions employed in the liquefaction zone. Other hydrogen-rich diluents may be used instead of or in addition to such coal derived liquids, particularly on initial startup of the process. Suitable aromatic hydrogen donor diluents include hydrogenated creosote oil, hydrogenated intermediate product streams from catalytic cracking of petroleum feedstocks, and other coal-derived liquids which are rich in indane, $C_{10}$ to $C_{12}$ tetralins, decalins, hydrogenated methylnaphthalene, hydrogenated dimethyl naphthalene, hydrogenated $C_{12}$ and $C_{13}$ acenaphthenes, and similar donor compounds.

Suitable ratios of hydrogen donor diluent to coal include a diluent to coal weight ratio ranging from about 0.8:1 to 4:1, preferably from about 1:1 to 2:1.

A suitable coal slurry is pretreated, in the absence of an added extraneous catalyst, with a gaseous mixture comprising at least 5 mole percent hydrogen sulfide, preferably from about 5 to about 15 mole percent hydrogen sulfide. Preferably, the gaseous mixture also comprises hydrogen. Suitable hydrogen sulfide-containing gases include refinery process off-gases comprising light hydrocarbons, recycle hydrogen streams containing $H_2S$, e.g. from coal liquefaction processes. The coal slurry is pretreated while being heated from a temperature ranging from about 343° C to about 449° C, at a pressure ranging from atmospheric to about 5000 psig, preferably, from about 500 to 3000 psig for a period of time of at least about 8 minutes, preferably a period of time ranging from about 8 to about 15 minutes. Pretreatment, for example, may be conducted in a preheating furnace.

The resulting treated product effluent is subsequently subjected to a coal liquefaction step. Prior to the coal liquefaction step, the effluent may be separated into gaseous and liquid phases and, if desired, at least a portion of the gaseous phase containing hydrogen sulfide may be recycled to the pretreatment zone. At least a portion of the pretreated effluent is introduced into a coal liquefaction zone where it is subjected to coal liquefaction conditions. Any suitable conditions which will convert coal to coal liquids may be employed. For example, suitable conditions for coal liquefaction include a temperature ranging from about 400 to 538° C. (752 to 1000° F.), preferably from about 416 to about 482° C. (780.8 to 899.6° F.), more preferably from about 450 to 482° C. (842 to 899.6° F.) at a pressure of at least 350 psig to about 5000 psig. Reaction time of about 5 minutes to several hours may be used, preferably from about 15 minutes to about 2 hours.

Preferably, the coal liquefaction process is a hydrogen-donor liquefaction process. When the coal liquefaction step is conducted in the presence of molecular hydrogen in the liquefaction zone, suitable partial hydrogen pressure may range from about 500 psig to about 5000 psig, preferably, from about 1000 to about 3000 psig.

The effluent of the coal liquefaction zone comprises gases, an oil product and a solid residue. The effluent may be passed to a separation zone from which gases are removed overhead. This gas may be scrubbed by conventional methods to remove any undesirable amount of hydrogen sulfide and carbon dioxide and, thereafter, it may be recycled to the coal liquefaction zone. The solids may be separated from the oil product by conventional means, for example, by settling or centrifuging, filtration, magnetic separation of electrostatic separation of the oil-solids slurry. Alternatively, the solids may be separated from the bulk of the liquid product by distillation of the lighter fractions to concentrate the solids in the heavy bottoms. If desired, at least a portion of the separated solids or solids concentrate may be recycled directly to the coal liquefaction zone or recycled to the coal liquefaction feedstock.

The process of the present invention may be conducted either as a batch or as a continuous type process.

The following example is presented to illustrate the invention.

EXAMPLE

Experiments were made utilizing a treat gas comprising hydrogen or hydrogen plus hydrogen sulfide and a feed comprising coal and hydrogenated creosote oil as hydrogen donor diluent. The results of these experiments are shown in the accompanying figure in which the yield of toluene insoluble carbonaceous material (includes ash, 9.5 wt. % of coal) is plotted against the time interval used in raising the liquefaction feed temperature from 343 to 449° C. Numerals inside the points on the plot show the mole % $H_2S$ used with hydrogen in the liquefaction tests during the pretreatment stage.

The liquefaction reaction consisted of a 30 minute stirred contact at 449° C. As can be seen from the figure, the hydrogen sulfide concentration and pretreatment heat up time are critical. If the time interval for heating the liquefaction feed from 343 to 499° C is short, that is, less than about 8 minutes, the benefit derived from $H_2S$ addition is small, i.e. the line approaches the zero $H_2S$ toluene insoluble yield of 35.2% regardless of $H_2S$ concentration. Significant decreases in toluene insoluble matter (increased liquid yield) can be obtained by extending the time interval to approximately 13 to 15 minutes, provided that the $H_2S$ concentration in the treat gas is at least 5 mole percent, preferably in the range of about 8 to 10 mole percent.

What is claimed is:

1. A process for the liquefaction of coal, which comprises the steps of:

(a) treating a slurry comprising coal and a hydrogen donor diluent with a gaseous mixture comprising at least 5 mole percent hydrogen sulfide for a period of time of at least 8 minutes at a temperature varying from about 343° C. to about 449° C., and a pressure ranging from atmospheric to about 5000 psig, and (b) subjecting at least a portion of the product resulting from step (a) to coal liquefaction conditions including a temperature ranging from about 450° C. to about 482° C. and a pressure ranging from about 350 psig to about 5000 psig, in a coal liquefaction zone, said portion of product comprising a gaseous phase and a liquid phase.

2. The process of claim 1, wherein said gaseous mixture comprises from about 5 to about 15 mole percent hydrogen sulfide.

3. The process of claim 1 wherein said gaseous mixture comprises from about 8 to about 10 mole percent hydrogen sulfide.

4. The process of claim 1, wherein said period of time of step (a) ranges up to about 15 minutes.

5. The process of claim 1 wherein said gaseous mixture of step (a) also comprises hydrogen.

6. The process of claim 1 wherein said treatment of step (a) is conducted in the absence of added extraneous catalyst.

7. The process of claim 1 wherein said treatment of step (a) is conducted at a pressure ranging from about 500 psig to about 3000 psig.

8. The process of claim 1 wherein a hydrogen-containing gas is introduced into said coal liquefaction zone.

9. The process of claim 1 wherein at least a portion of said hydrogen sulfide is removed from the treated product effluent prior to step (b).

10. The process of claim 1 wherein the product resulting from step (a) is separated into a gaseous phase and a liquid phase prior to said coal liquefaction step.

11. A process for the liquefaction of coal, which comprises the steps of:

(a) treating a slurry comprising coal and a hydrogen donor diluent, in the absence of extraneous added catalyst, with a gaseous mixture comprising hydrogen and from about 8 to about 10 mole percent hydrogen sulfide for a period of time of at least about 8 minutes at a temperature varying from about 343° C. to about 449° C., and a pressure ranging from atmospheric to about 5000 psig and, (b) subjecting at least a portion of the product resulting from step (a) to coal liquefaction conditions including a temperature ranging from about 450° C. to about 482° C. and a pressure ranging from about 350 psig to about 5000 psig, in the presence of hydrogen, said portion of product comprising a gaseous phase and a liquid phase.

12. The process of claim 11 wherein the product resulting from step (a) is separated into a gaseous phase and a liquid phase prior to said coal liquefaction step.

13. A process for the liquefaction of coal, which comprises the steps of:

(a) treating a slurry comprising coal and a hydrogen donor diluent with a gaseous mixture comprising at least 5 mole percent hydrogen sulfide for a period of time of at least 8 minutes at a temperature varying from about 343° C. to about 449° C., and at a pressure ranging from atmospheric to about 5000 psig, (b) separating the product resulting from step (a) into a gaseous phase and a liquid phase, and (c) subjecting at least a portion of said liquid phase to coal liquefaction conditions.

14. The process of claim 13 wherein said coal liquefaction conditions include a temperature ranging from about 400 to 538° C., and a total pressure ranging from about 350 to about 5000 psig.

* * * * *